US009603495B2

(12) United States Patent
Manfredonia et al.

(10) Patent No.: US 9,603,495 B2
(45) Date of Patent: Mar. 28, 2017

(54) EARRING POST WIPE DISPENSER

(71) Applicants: Marcie Manfredonia, Bedford Hills, NY (US); Nicholas Siciliano, Bedford Hills, NY (US)

(72) Inventors: Marcie Manfredonia, Bedford Hills, NY (US); Nicholas Siciliano, Bedford Hills, NY (US)

( * ) Notice: Subject to any disclaimer, the term of this patent is extended or adjusted under 35 U.S.C. 154(b) by 0 days.

(21) Appl. No.: 14/193,163

(22) Filed: Feb. 28, 2014

(65) Prior Publication Data

US 2015/0245747 A1 Sep. 3, 2015

(51) Int. Cl.

| | |
|---|---|
| ***A47F 1/00*** | (2006.01) |
| ***A47K 10/42*** | (2006.01) |
| *A47K 10/32* | (2006.01) |

(52) U.S. Cl.

CPC ..... *A47K 10/426* (2013.01); *A47K 10/424* (2013.01); *A47K 2010/3273* (2013.01)

(58) Field of Classification Search

CPC ..... A47K 10/426; A47K 10/424; A47K 2010/3273

USPC ..... 206/233, 38; 221/96, 102; 222/192, 129, 222/321.7, 321.9, 383.1, 166, 183, 190; 239/52, 34

See application file for complete search history.

(56) References Cited

U.S. PATENT DOCUMENTS

| | | | | |
|---|---|---|---|---|
| 971,800 A | | 10/1910 | Sutton | |
| 1,800,214 A | | 4/1931 | Gollnick | |
| 2,044,284 A | * | 6/1936 | Dargavel | A47F 1/08 118/425 |
| 2,436,291 A | | 2/1948 | Daniel | |
| 2,440,974 A | | 5/1948 | Resch | |
| 2,627,619 A | | 2/1953 | Gagen | |
| 2,789,725 A | * | 4/1957 | Carper | A47K 10/427 206/233 |
| 3,189,228 A | * | 6/1965 | Steinbart | A61F 15/001 222/129 |
| 3,368,522 A | | 2/1968 | Cordis | |
| 3,865,271 A | | 2/1975 | Gold | |
| 3,947,134 A | * | 3/1976 | Ogawa | A47K 10/32 118/302 |
| 3,980,203 A | * | 9/1976 | Dearling | A47K 10/32 221/96 |

(Continued)

FOREIGN PATENT DOCUMENTS

| | | |
|---|---|---|
| DE | 20305272 U1 | 9/2003 |
| DE | 102010036072 A1 | 3/2012 |
| GB | 1417306 | 12/1975 |

OTHER PUBLICATIONS

International Search Report dated May 15, 2015 from corresponding International Patent Application No. PCT/US15/16857, 3 pages.

(Continued)

*Primary Examiner* — Rakesh Kumar

(74) *Attorney, Agent, or Firm* — Ohlandt, Greeley, Ruggiero & Perle, L.L.P.

(57) ABSTRACT

The present disclosure provides an apparatus for dispensing an earring post wipe. The apparatus has a container that includes a reservoir with a cleaning or sanitizing fluid. The reservoir has a fluid application tip for applying the cleaning or sanitizing fluid to a dry wipe. The fluid application tip is actuated by movement of the wipe through a slot in the container.

20 Claims, 8 Drawing Sheets

(56) References Cited

U.S. PATENT DOCUMENTS 4,069,789 A * 1/1978 Fukagawa ..... B65H 35/0046 118/264
4,543,913 A * 10/1985 Wilkeson ..... A01K 13/003 119/603
4,598,664 A * 7/1986 Hamlin ..... A47K 10/32 118/32
4,667,846 A * 5/1987 Marceau ..... A47K 10/32 221/34
4,759,652 A * 7/1988 Ulrich ..... A45D 34/00 15/222
4,787,516 A 11/1988 Morrison
5,312,021 A * 5/1994 Nelson ..... A47K 10/32 221/96
H1350 H 9/1994 Desmond et al.
5,439,104 A * 8/1995 Wolska-Klis ..... G02C 13/006 206/233
5,639,310 A 6/1997 Giampolo, Jr.
5,676,990 A 10/1997 Wawrzynski
5,887,759 A * 3/1999 Ayigbe ..... A47K 10/32 118/325
6,021,919 A * 2/2000 Kelly ..... A61B 42/40 221/155
6,059,882 A 5/2000 Steinhardt et al.
6,085,899 A 7/2000 Thorsbakken
6,170,426 B1 1/2001 Thorsbakken
6,319,318 B1 11/2001 Pekarek et al.
6,321,937 B1 * 11/2001 DeSimone ..... A47K 10/3818 221/45
6,401,972 B1 6/2002 Schlattl et al.
6,523,714 B2 2/2003 Serbiak
6,613,144 B1 * 9/2003 Loertscher ..... A47K 10/32 118/302
6,691,897 B2 2/2004 Ashe
6,789,695 B1 * 9/2004 Gaudreau ..... A47K 10/424 206/449
7,018,472 B2 3/2006 Yamauchi
7,018,473 B2 * 3/2006 Shadrach, III ..... A47K 10/3818 118/315
7,185,841 B2 * 3/2007 Kaufmann ..... 242/564.4
7,222,747 B1 * 5/2007 Savran ..... 221/34
7,264,414 B2 9/2007 McReynolds et al.
7,318,949 B2 1/2008 Shadrach, III
7,370,754 B2 * 5/2008 Kushner ..... B08B 1/00 206/233
RE40,408 E 7/2008 McConnell et al.
7,497,351 B2 * 3/2009 Amundson ..... A47K 10/421 221/135
7,850,041 B2 12/2010 Amundson et al.
8,256,644 B2 * 9/2012 Orgna ..... A47K 5/1202 221/45
2008/0135570 A1 6/2008 Lee
2008/0257906 A1 * 10/2008 Orgna ..... A47K 5/1202 221/303
2009/0032553 A1 * 2/2009 Eddy ..... A61L 9/14 222/192
2009/0090737 A1 * 4/2009 Franco ..... A47K 10/424 221/96
2011/0084089 A1 4/2011 Maccario
2015/0245747 A1 * 9/2015 Manfredonia ..... A47K 10/426 221/96

OTHER PUBLICATIONS

International Written Opinion dated May 15, 2015 from corresponding International Patent Application No. PCT/US15/16857, 5 pages.

* cited by examiner

EARRING POST WIPE DISPENSER

BACKGROUND OF THE DISCLOSURE

1. Field of the Disclosure

The present disclosure relates to an apparatus for dispensing a sanitizing wipe. More particularly, the present disclosure relates to a container for dispensing wipes for sanitizing an earring post.

2. Field of the Related Art

A consumer wanting to purchase jewelry, especially a pair of earrings, often desires to try on the earrings prior to purchasing them to determine how the earrings appear on him or her. A consumer will often try on several different pairs of earrings before making a selection. For example, a consumer will try on an earring to determine whether it fits comfortably and/or how the earrings look on them.

Most earrings attach to a person's ear through a hole or piercing in the ear. A piercing is essentially a puncture or cut through a part of the human body creating an opening through which the earring is worn.

A typical earring has a post that goes through the piercing, a backing that keeps the earring in place on the ear, and an adornment for decoration. Typical adornments include gems and metals of different shapes, sizes, and combinations. The backing prevents the loss of the earring.

Earrings come in many shapes, sizes, styles, and weights. Examples of earring styles are stud, hoop, semi hoop, dangle, huggy, drop, and chandelier.

However, trying on a pair of earrings and, then returning the pair back to the store clerk presents sanitary risks. Many people handle jewelry in jewelry stores. Bacteria and/or undesired material, such as a particle of dirt, can accumulate on earring posts, especially when the posts have been inserted into a pierced ear of another consumer. In extreme cases, contaminated earring posts can contain foreign blood cells. Contaminated earring posts can also cause localized skin reactions.

To avoid sanitary risks, consumers resort to holding the earrings in place with their hands. This allows the consumer to envision how the earring might look, but requires the consumer to imagine what it might look like without their hand.

Further, earrings have different weights. By merely holding an earring to an ear, a consumer cannot feel the weight of the earring on their ear. The consumer also cannot ascertain how the earrings will stretch their ears or naturally hang or dangle.

BRIEF SUMMARY OF THE PRESENT DISCLOSURE

The present disclosure provides an apparatus for dispensing wipes to clean and/or sanitize earring posts.

The present disclosure also provides an apparatus for selectively wetting and dispensing individual wipes to clean and/or sanitize earring posts.

The present disclosure further provides a device for mounting the apparatus on a counter display.

In one embodiment, the present disclosure still further provides a device for mounting the apparatus on a mirror of a counter.

In an embodiment of the present disclosure, a receptacle for disposing a used wipe is provided.

DETAILED DESCRIPTION OF THE DRAWINGS

Figure 1:
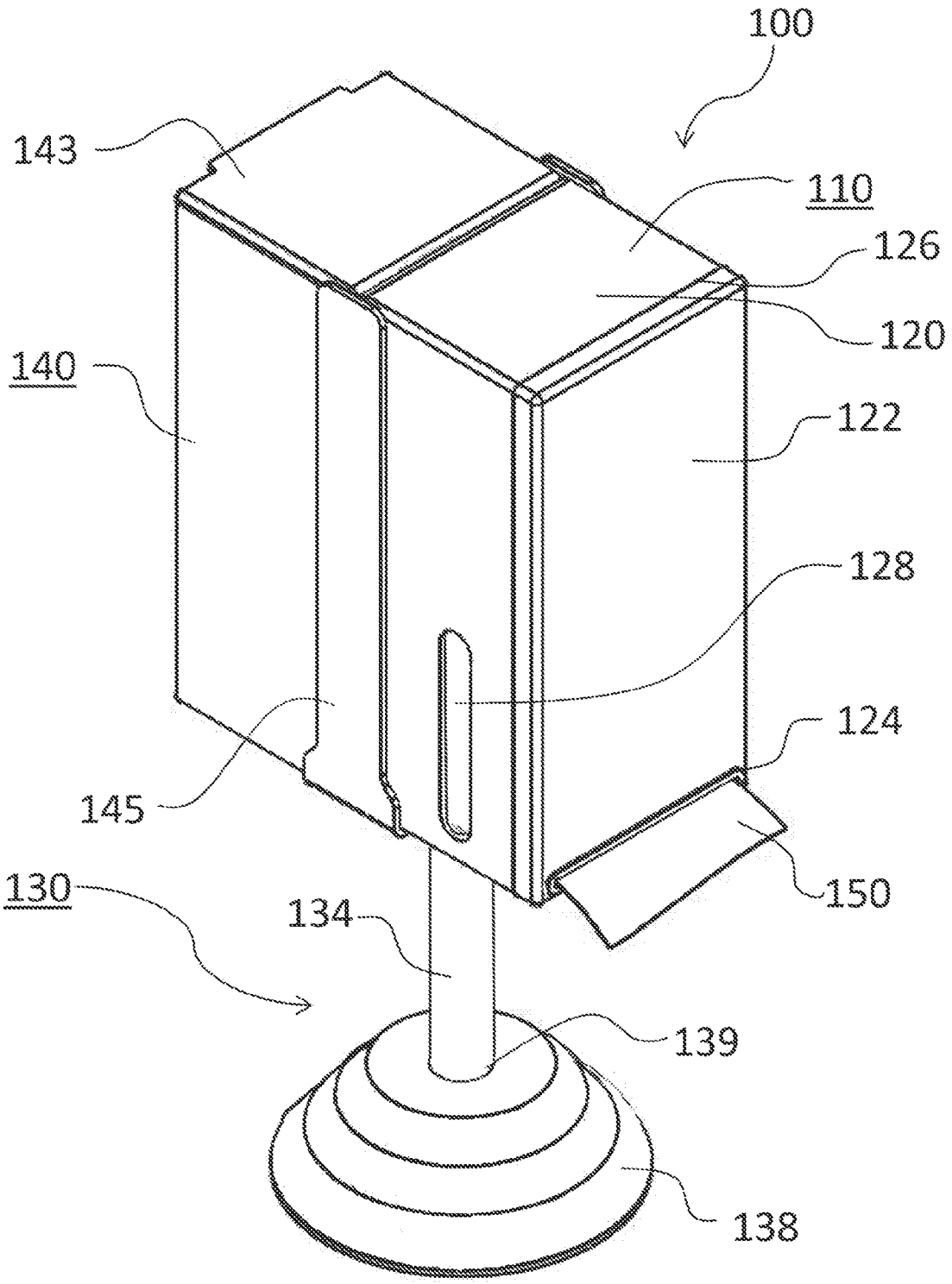
FIG. 1 is a perspective view of an apparatus for dispensing wipes for an earring post according to the present disclosure.

Referring to the drawings and, in particular, FIGS. 1 through 4, there is shown an apparatus or container for dispensing a wipe for an earring post according to the present disclosure generally represented by reference numeral 100.

Apparatus 100 includes a dispenser 110 for dispensing the wipes 150 and, in the embodiment shown in FIGS. 1 through 4, a stand 130 and receptacle 140 for discarded wipes. Dispenser 110 has a body 120 having a front wall 122 with a horizontal slot or opening 124 therethrough from which wipe 150 is singularly removed. Front wall 122 preferably has a hinge 126 by which the front wall connects to and pivots about body 120 to provide access to the inside of dispenser 110. Hinge 126 can be any attachment device. Alternatively, front wall 122 can be removable 123. Dispenser 110 is shown in an enlarged view. The wipes 150, since only for use to clean earring posts, will be much smaller and narrower in width than wipes normally used to clean ones hands or a hard substrate. The wipes 150 are dry when placed into position in the dispenser 110. Since this dispenser is only used for earring post wipes, the size of body 120 of dispenser 110 is preferably about 2.5 inches in width by about 4.5 inches in height by about 2 inches in depth. Dispenser 110 can also be sized such that body 120 of dispenser 110 is 1-4 inches in width by 2-8 inches in height by 1-5 inches in depth or any subranges therebetween.

Figure 3:
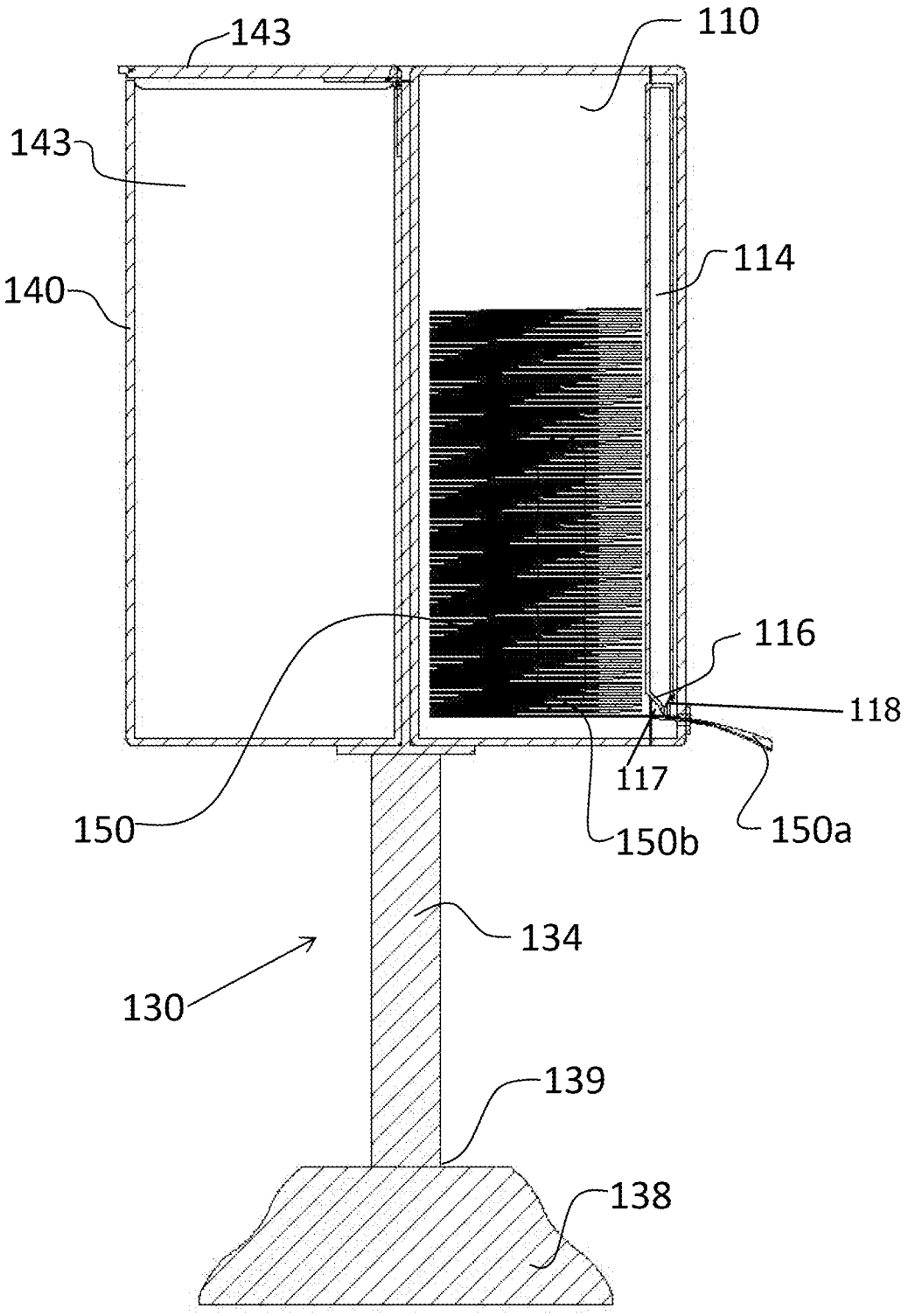
FIG. 3 is a cross sectional perspective view of the dispenser of the apparatus of FIG. 1.
Figure 4:
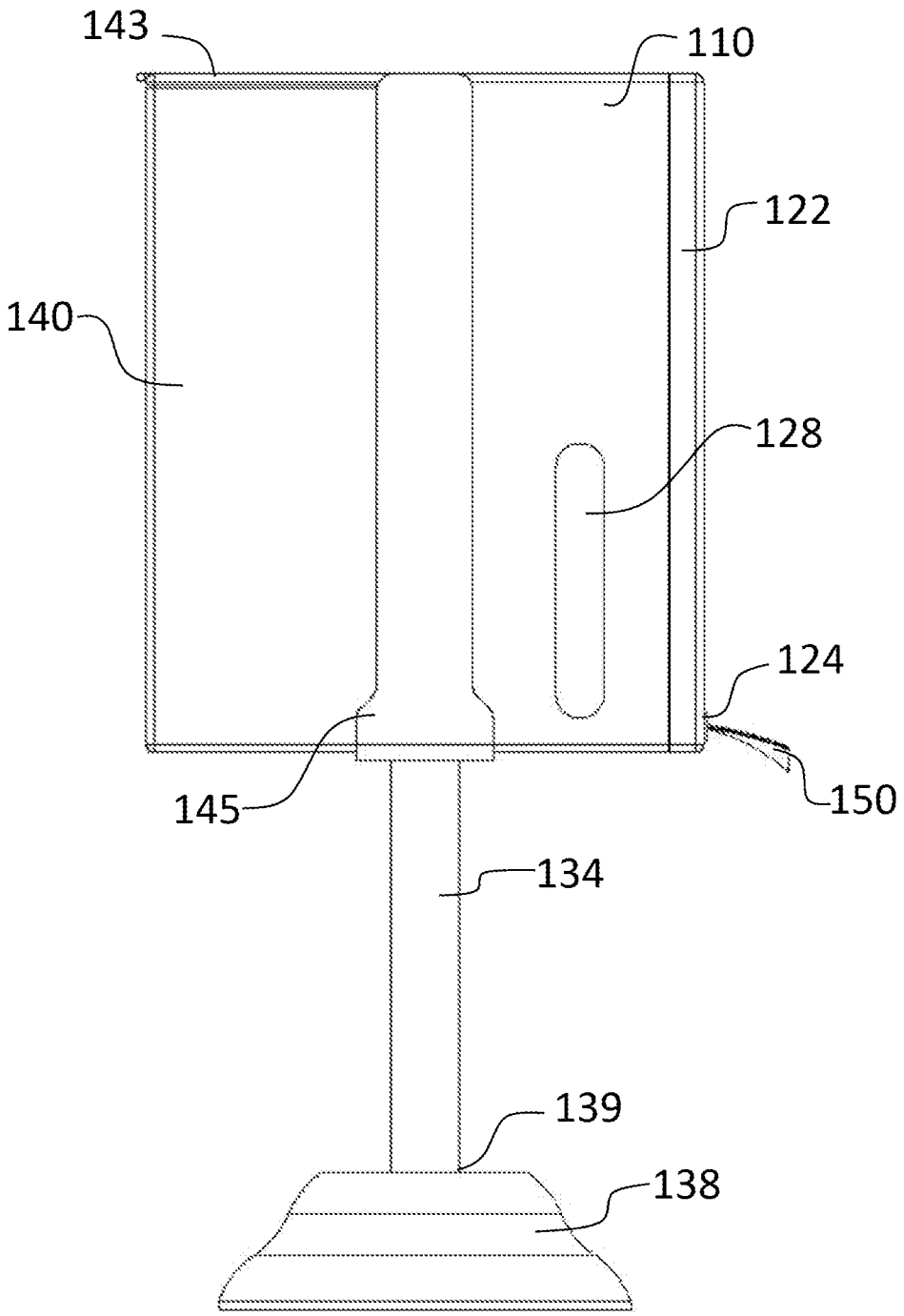
FIG. 4 is a side view of the dispenser of the apparatus of FIG. 1.

As shown in the embodiment in FIGS. 1, 3 and 4, dispenser 110 can be positioned on a stand 130. Stand 130 is preferably a pedestal stand that can be positioned on a counter top. Stand 130 has a pedestal or stem 134 and a base 138. Stem 134 is preferably attached to a bracket 145 that supports body 120. Stem 134 also slides into an aperture or hole 139 of base 138. Base 138 is preferably weighted to prevent the apparatus from tipping over when a wipe 150 is removed. While shown as a circular base, base 138 can be any shape.

Dispenser 110 has therein a vertical column structure or reservoir 114 for receipt of a cleaning and/or sanitizing substance 160. Reservoir 114 has an end portion or tip 116 that is formed into a V-shaped tip so that the cleaning and/or sanitizing substance can be emitted from the column in a metered-typed fashion and applied to wipe 150 to make the wipe moist for cleaning or disinfecting an earring post.

Figure 8:
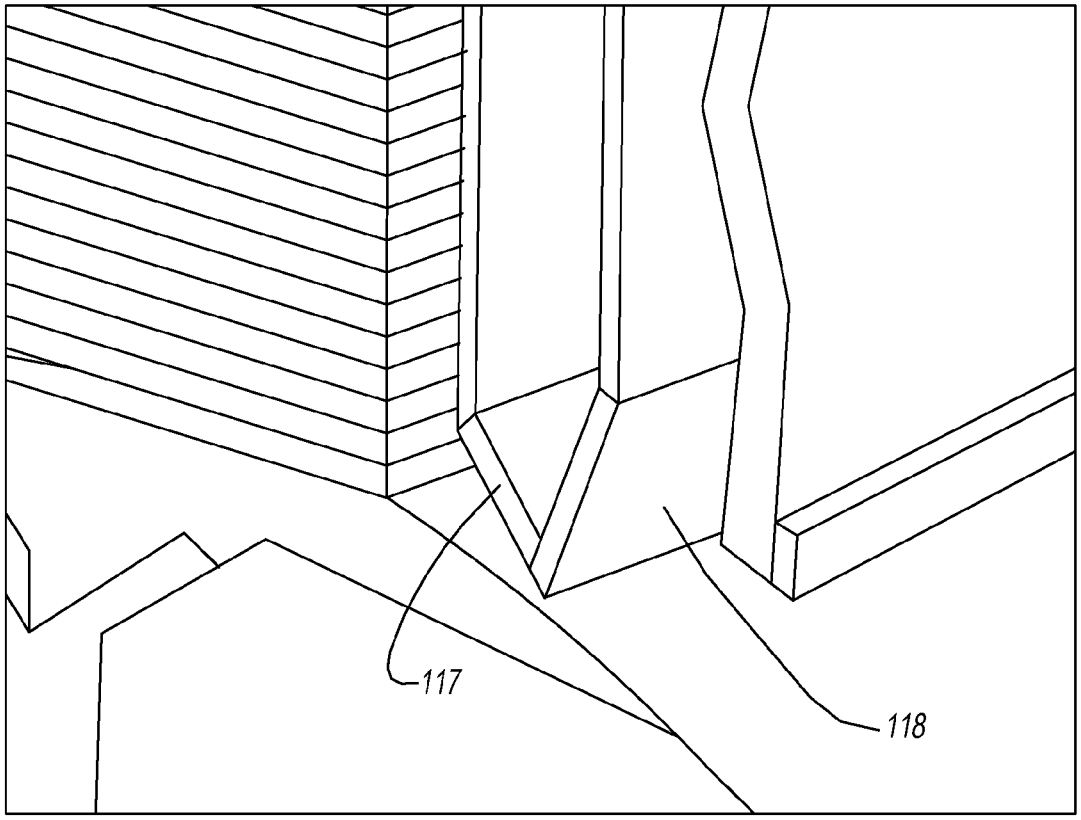
FIG. 8 is an exploded view of the V-shaped tip as shown in FIG. 2.

Preferably, the end portion or tip 116 has a first rubber tab 117 and a second, larger rubber tab 118 that are tensioned against each other to form a V-shaped tip and to create a compressive seal 119, preventing reservoir 114 from emptying. (See FIG. 8) Larger rubber tab 118 is preferably proximate to slot 124 while first rubber tab 117 is distal to slot 124. Preferably, slot 124 has an edge 125 that removes excess cleaning or sanitizing material from the wipes 150 being emitted.

Preferably, wipes 150 are stacked in a bi-fold manner in dispenser 110. By using such stacking, a first wipe is removed from dispenser 110, a second wipe shown as 150*a* is pulled just through slot 124, and a third wipe 150*b* is moved to be the lowest in the stack and about to approach tip 116. Wipes 150 can also be simply stacked upon one another; however there should be some mechanism so that when one wipe 150*a* is removed from dispenser 110, a second wipe 150*b* is in brought into position through slot 124 to be later removed. Wipes 150 can also be tri-fold, or have any other fold pattern that allows singular removal from dispenser 110. A first wipe 150 can have a tab to assist with first wipe removal when apparatus 100 is first used.

As stated above, dispenser 110 has a reservoir 114 that can be filled with cleaning fluid or sanitizer 160. Sanitizer 160 is applied to wipes 150 by tip 119 as a wipe150 is pulled through slot 124. Tip 116, as mentioned above, has first rubber tab 117 and a second, larger rubber tab 118 tensioned against each other to prevent reservoir 114 from leaking fluid. Sanitizer 160 is gravity fed. As wipe 150, which is in contact with rubber tab 118, is pulled through slot 124, friction between the wipe and rubber tab 118 causes the tensioned seal to open and sanitizer 160 to flow onto the wipe. Once wipe 150 is removed, rubber tab 118 springs back into place and the tensioned seal 119 prevents further dispensing of sanitizer 160. Reservoir 114 can be built onto front wall 122. Alternatively, reservoir 114 can be a separate structure that is connected adjacent to front wall 122 by any conventional mechanisms. Such mechanisms include, but are not limited to, adhesive, clips, and fasteners such as rivets.

Optionally, a bottom plate (not shown) of dispenser 110 can collect any excess of sanitizer 160 that was not applied to wipe 150.

Sanitizer 160 is can be a cleaning fluid. Sanitizer 160 should be a bacterial disinfectant. Sanitizer 160 can be a gel or a liquid. Thus, sanitizer 160 should be a sanitizing disinfectant, such as for example, isopropanol, ethanol, hydrogen peroxide, ethyl alcohol, benzalkonium chloride, or chloroxylenol among others. Sanitizer 160 can also include antimicrobial agents, antiseptics, or oxidizing agents. Preferably, sanitizer 160 evaporates within minutes of application onto wipe 150. Sanitizer 160 should be unscented. Sanitizer 160 can optionally include any combination of the following inactive ingredients: aloe vera gel, aminomethyl propanol, behentrimonium chloride, behenyl alcohol, benzophenone-4, c20-40 pareth-24, carbomer cellulose, cetyl palmitate, dea-c*-18 perfluoroalklyethyl phosphate, dihydroxyethyl cocamine oxide, dihydroxypropyl peg-5 linoleammonium chloride, diisopropyl dimer dilinoleate, dimethicone, glycereth-2cocoate, glycerin, hydroxypropyl, isopropyl alcohol, mannitol, methylcellulose, peg-75 lanolin, polyethylene glycol, propyleneglycol, red 33 (ci 17200), red 4 (ci 14700), retinyl palmitate, squalane, tocopheryl acetate, triethanolamine, water, yellow 5 (ci 19140), and beheneth-10.

Materials for wipes 150 can be any conventional wipe known in the art that is able to absorb a sufficient amount of sanitizer to disinfect an earring post. Such materials can be cloth, paper, or other fibrous material. Preferably, wipes 150 are non-linting, durable, and textured. Wipes 150 should be 2 inches by 1.5 inches, but can be any combination or subranges of length and width between 0.75 inches and 3 inches.

Figure 2:
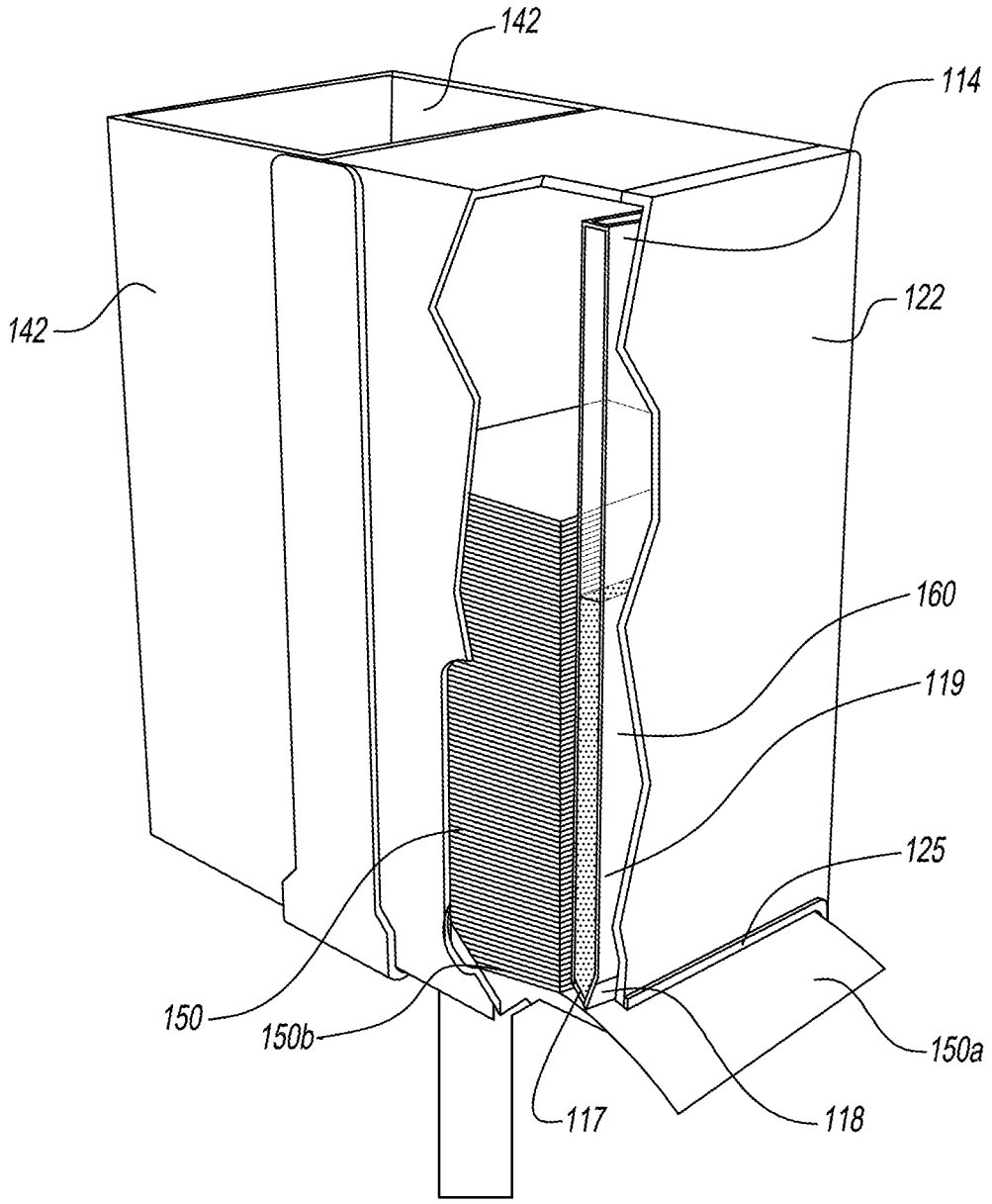
FIG. 2 is a perspective view in partial cutaway of the apparatus of FIG. 1.

Referring to FIGS. 1, 2 and 3, receptacle 140 has in the inside thereof a volume 142 for receipt and retention of dry wipes 150. A lid 143 for covering volume 142 is attached to receptacle 140. Lid 143 can be attached by a hinge, have a snap-fit closure, or may simply rest atop receptacle 140. Receptacle 140 can be integrated or a part of dispenser 110. Preferably, receptacle 140 can be attached to dispenser 110, but can also be attached to bracket 145 on a connecting structure (not shown). Receptacle 140 has a receptacle opening or volume 142 into which each used wipe 150 can be placed for disposal after use. Preferably, receptacle 140 is sized identical to dispenser 110, but can also be smaller or larger.

Receptacle 140 can support a bag, such as a plastic garbage bag or bag of a non-permeable material 141 that can be sealed for further disposal of discarded wipes 150. Advantageously, a bag prevents any excess sanitizer 160 from leaking and soiling receptacle 140.

Dispenser 110 and receptacle 140 can be made of metal, plastic, or cardboard, but is preferably of a light weight material. Examples of materials can be low density polyethylene (LDPE), poly vinyl chloride (PVC), or polyethylene terephthalate (PET/PETE). Dispenser 110 and receptacle 140 can be a single body or be unitary bodies attachable to each other and or bracket 145.

Dispenser 110 and receptacle 140 can be disposable or permanent. Alternatively, wipes 150 and sanitizer 160 can be refillable, and discarded wipes removable.

Dispenser 110 and receptacle 140 can have a vertical track (not shown) on each side for removable sliding into place and securing onto bracket 145. Alternatively, dispenser 110 and receptacle 140 can attach to bracket 145 by another fastening mechanism which permits removal and replacement.

Dispenser 110 can have a window 128 cutout of body 120 for displaying a quantity of wipes 150 remaining in the dispenser.

Figure 5:
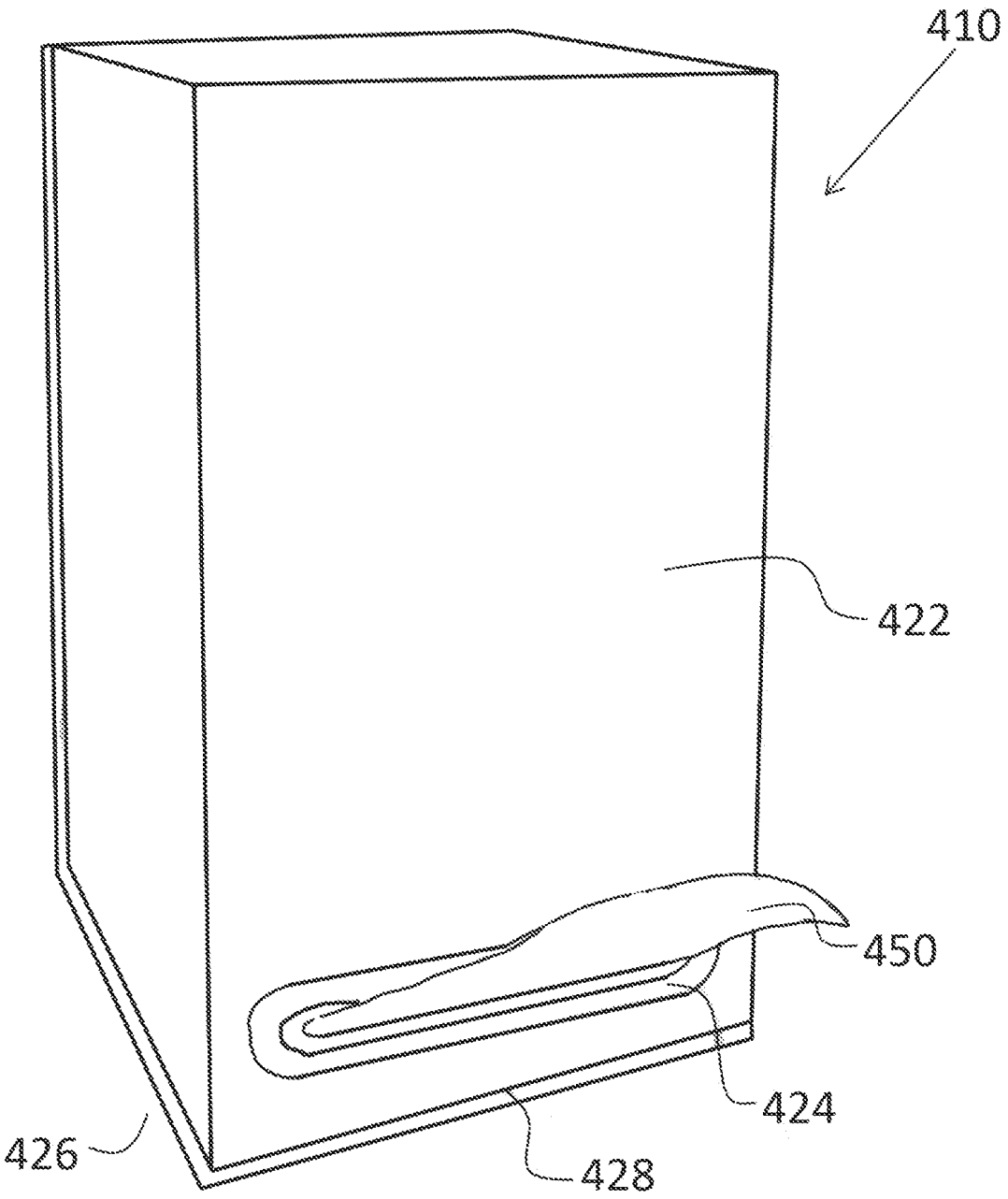
FIG. 5 is perspective view of a second embodiment of the apparatus of the present disclosure.

FIG. 5 shows an alternate embodiment of the present disclosure. A dispenser or container 410 has a front face 422 with a slot 424. One wipe 450, at a time, is removed through slot 424. Upper rubber blade 426 and lower rubber blade 427 positioned at slot 424 are used to control the flow and amount of sanitizer 460 (see FIG. 6) on wipe 450 when removed from dispenser 410.

Figure 6:
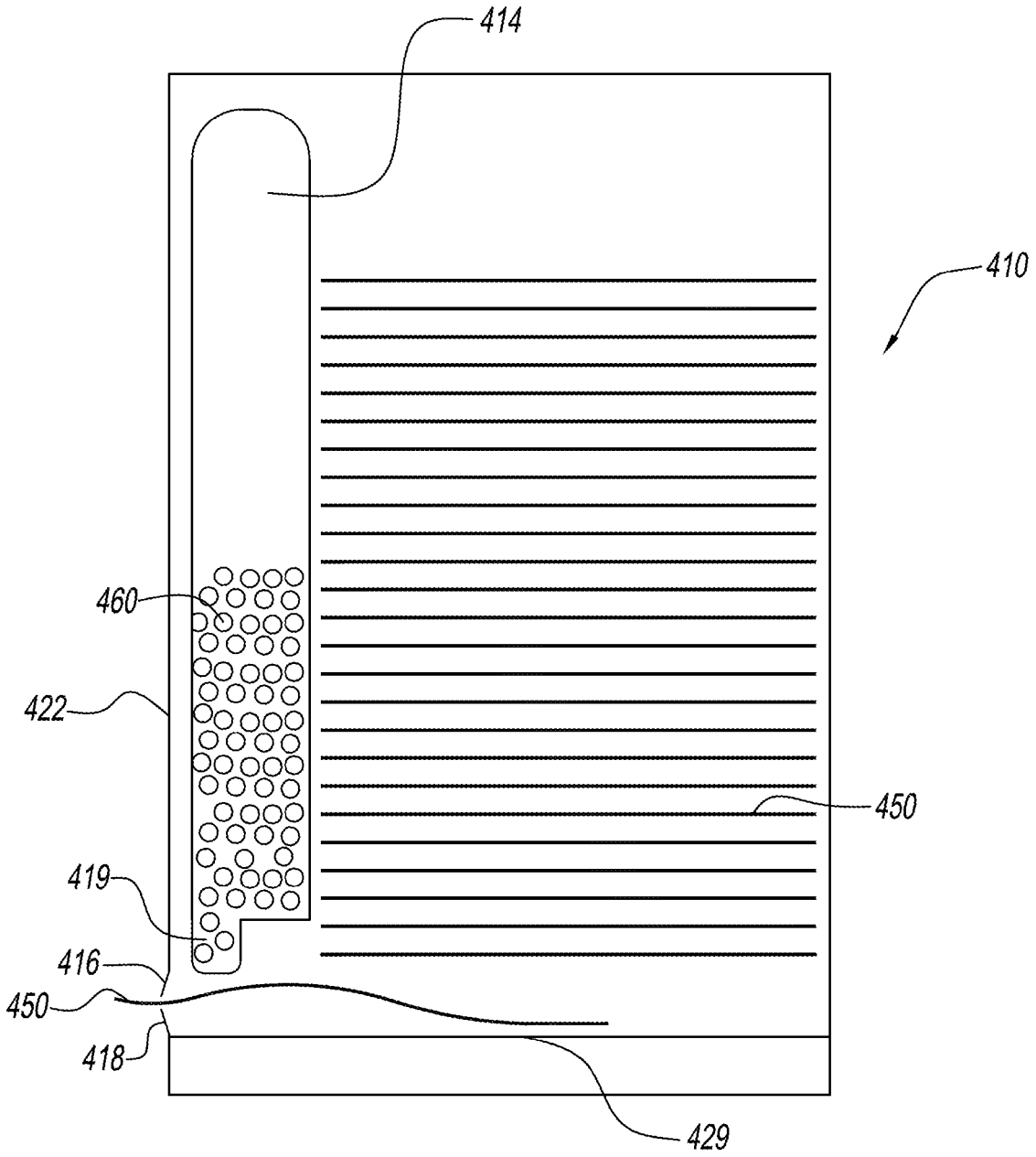
FIG. 6 is a cross sectional side view of the apparatus of FIG. 6.

Referring to FIG. 6, dispenser 410 has a reservoir 414 that can contain a sanitizer 460. Reservoir 414 can be mounted to an inside surface of front wall 422 of dispenser 410. Reservoir 414 has an upper blade 416 and lower blade 418 that forms a tip 419. Reservoir 414 uses gravity to feed sanitizer 460 to wipes 450.

As with the embodiment of FIG. 1, sanitizer 460 can be a gel or a liquid.

Sanitizer 460 is delivered or applied onto wipes 450 through tip 419. Dispenser 410 has a bottom plate 429 that holds wipes 450. Bottom plate 429 can be angled so that sanitizer 460 collects and maintains the moisture level of wipes 450 to a predetermine level. Wipes 450 are interwoven and stacked so that when a first wipe is dispensed, the first wipe pulls a second wipe into the removable position. As wipe 450 is dispensed, upper blade 416 and lower blade 418 remove excess sanitizer 460 from wipe 450. Upper and lower blades 416 and 418 can also serve to keep the exposed portion of the wipe dry and the internal portion of the wipe moist.

Figure 7:
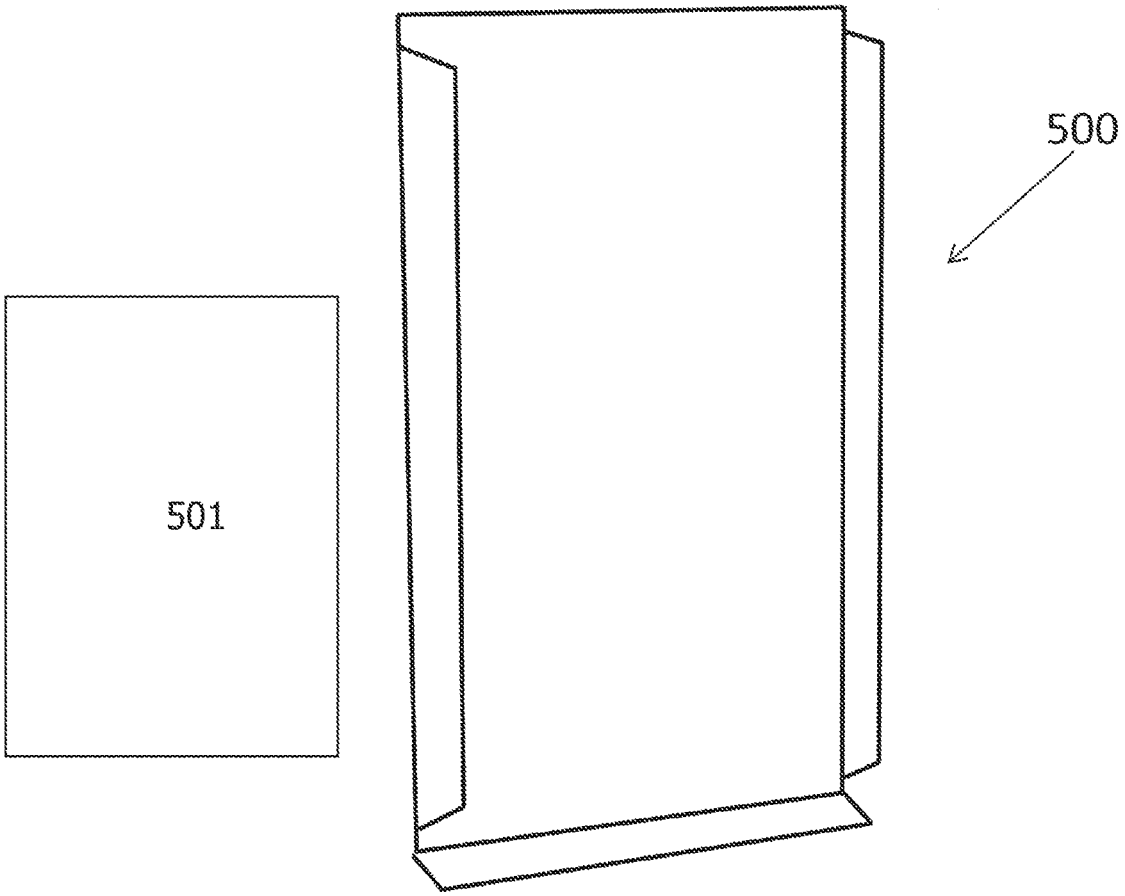
FIG. 7 is a perspective view of a mounting plate for the apparatus of FIG. 5.

FIG. 7 is a mounting structure or plate 500 that can be part of or separate from dispenser 410. Plate 500 can be used to hold dispenser 410 in place on a mirror 501, e.g., a mirror on a display counter in which earrings are sold.

The techniques described herein are exemplary, and should not be construed as implying any particular limitation on the present disclosure. It should be understood that various alternatives, combinations, and modifications could be devised by those skilled in the art from the present disclosure. For example, steps associated with the processes or methods described herein can be performed in any order, unless otherwise specified or dictated by the steps themselves. The present disclosure is intended to embrace all such alternatives, modifications, and variances that fall within the scope of the appended claims.

It is claimed:

1. An apparatus for dispensing a wipe to clean an earring post, the apparatus comprising:

a container having a front wall and a bottom plate for supporting the wipe;

a horizontal slot in the front wall through which the wipe can be pulled; and a reservoir positioned adjacent to the front wall, above the bottom plate, and in the container, wherein the reservoir can be filled with a cleaning fluid, wherein the reservoir has a fluid application tip that emits cleaning fluid upon actuation, the fluid application tip including a first tab and a second tab that extend along a length of the horizontal slot and that bias together to form a compressive seal at the fluid application tip, wherein the second tab extends beyond the first tab and the compressive seal, wherein the second tab is adapted to be in contact with the wipe, and wherein the fluid application tip is frictionally actuated to emit the cleaning fluid by friction between the wipe and the second tab by pulling the wipe through the slot.

2. The apparatus of claim 1, wherein the first tab and the second tab are made of rubber.

3. The apparatus of claim 1, wherein the first tab and the second tab form a V-shaped tip.

4. The apparatus of claim 1, further comprising a stand.

5. The apparatus of claim 1, further comprising a plate for securing the container to a mirror.

6. The apparatus of claim 1, further comprising:

a cutout in the container for displaying a quantity of wipes.

7. The apparatus of claim 1, wherein the cleaning fluid further comprises a sanitizer.

8. The apparatus of claim 1, wherein an active ingredient in the cleaning fluid is at least one selected from the group consisting of isopropanol, ethanol, hydrogen peroxide, ethyl alcohol, benzalkonium chloride, and chloroxylenol.

9. The apparatus of claim 1, wherein the front wall is removably attached to the container.

10. The apparatus of claim 1, wherein the front wall is pivotably attached to the container.

11. The apparatus of claim 1, wherein the slot further comprises a cleaning fluid removing edge for removing cleaning fluid from the wipe being removed.

12. The apparatus of claim 1, wherein the cleaning fluid further comprises at least one selected from the group consisting of antimicrobial agents, antiseptics, and oxidizing agents.

13. The apparatus of claim 1 further comprising:

a receptacle integrated with the container, wherein the receptacle and container are mounted to a stand with a bracket.

14. The apparatus of claim 13, wherein the integrated receptacle and container have a vertical track for sliding on and off of the bracket.

15. The apparatus of claim 1, further comprising a receptacle for receipt of a used wipe.

16. The apparatus of claim 15, wherein the receptacle is a part of the container.

17. The apparatus of claim 15, wherein the receptacle further comprises a lid.

18. The apparatus of claim 15, wherein the receptacle can be attached to the container.

19. The apparatus of claim 15, wherein the receptacle is adapted to receive an impermeable bag.

20. The apparatus of claim 19, wherein the receptacle is connected to the container by a connecting structure.

* * * * *